US008479945B1

(12) United States Patent
Simmons

(10) Patent No.: US 8,479,945 B1
(45) Date of Patent: Jul. 9, 2013

(54) UNIVERSAL DRAIN PAN

(75) Inventor: Eric Michael Simmons, Champaign, IL (US)

(73) Assignee: Simmons Inventions LLC, Champaign, IL (US)

( * ) Notice: Subject to any disclaimer, the term of this patent is extended or adjusted under 35 U.S.C. 154(b) by 0 days.

(21) Appl. No.: 13/364,894

(22) Filed: Feb. 2, 2012

(51) Int. Cl.
*B65D 1/34* (2006.01)

(52) U.S. Cl.
USPC ..... 220/571; 220/573

(58) Field of Classification Search
USPC ..... 220/571, 573, 572
See application file for complete search history.

(56) References Cited

U.S. PATENT DOCUMENTS

| | | | | |
|---|---|---|---|---|
| 1,650,634 | A | 11/1927 | Lutzler | |
| 5,174,468 | A * | 12/1992 | Holderman | 220/571 |
| 5,351,931 | A * | 10/1994 | Houben et al. | 249/141 |
| 5,562,047 | A * | 10/1996 | Forney et al. | 108/57.13 |
| 5,577,539 | A * | 11/1996 | Shaw et al. | 141/332 |
| 5,908,133 | A * | 6/1999 | Luburic et al. | 220/572 |
| 6,349,656 | B1 * | 2/2002 | Mitchell | 108/57.13 |
| 6,874,549 | B1 | 4/2005 | Williams | |
| 6,941,703 | B2 * | 9/2005 | MacLean et al. | 52/34 |
| 7,124,771 | B2 * | 10/2006 | Frazier | 137/312 |
| 7,234,608 | B2 * | 6/2007 | Reed et al. | 220/571 |
| 7,737,372 | B2 * | 6/2010 | Dougherty et al. | 177/245 |
| 8,002,147 | B2 * | 8/2011 | Wells et al. | 222/108 |
| 2003/0141307 | A1 * | 7/2003 | Sanders et al. | 220/571 |
| 2004/0159664 | A1 * | 8/2004 | Reed et al. | 220/571 |
| 2007/0000944 | A1 | 1/2007 | Cahen et al. | |
| 2009/0218367 | A1 * | 9/2009 | Wells et al. | 222/108 |

OTHER PUBLICATIONS

Blitz USA online catalog, 6 Quart Oil Drain Item # 11896, http://www.blitzusa.com/products/oil/Oil%20Drains%20and%20Pans/podp6od.htm, Jan. 17, 2012.

Standard US Online catolog, Rhino Drip Tray Pan Insert—RTT-3100, http://standardus.com/stdshop/rhino-drip-tray-pan-insert-rtt-3100.html.

Fante's Online catolog, Steel Broilers, http://fantes.com/broilers.html, Jan. 30, 2012.

* cited by examiner

*Primary Examiner* — Steven A. Reynolds
*Assistant Examiner* — King M Chu
(74) *Attorney, Agent, or Firm* — Grant A. Gildehaus

(57) ABSTRACT

A universal drain pan with a complementary insert plate, each having supporting members that align to provide support throughout the plate, allowing for weighted objects to be placed upon the plate without deformation or failure. The insert plate has a series of funneled drain holes to direct the fluid into the pan and may have a mechanical filtration means, such as a screen, to prevent entrained foreign material and small component pieces from going into the fluid in the drain pan. The screen allows for inspection of, or retrieval of material prior to disposal or recovery. The drain pan has a drainage port and cap to allow for ease of disposal and a lid for transfer to the disposal point or for storage.

11 Claims, 4 Drawing Sheets

UNIVERSAL DRAIN PAN

CROSS-REFERENCE TO RELATED APPLICATION

N/A

BACKGROUND OF THE INVENTION

1. Field of the Invention

The present invention relates drain pans. Particularly drain pans to prevent accumulation of run off liquids and spoilage of stored or thawing food or drainage of machine components.

2. Description of the Related Art

Drain trays and pans are commonly used in a variety of applications to contain liquid run off and drippage, such as beverage dispensers, machinery, and condensate drainage catches.

Some drainage assemblies incorporate a support plate or the like for resting an object above the enclosure. Those capable of supporting objects of any substantial weight are made from heavy materials to provide support or are made from light materials, but only span small spaces. Most can support only small weights primarily due to the use of over edge support or edge lip supports. A plate having no support from underneath is subject to deformation and ductile or brittle failure from the load placed on the plate.

Other drainage assemblies incorporate a light weight screen metal or plastic that is suitable for preventing entrained foreign material from entering the drain pan, but are not suitable for support of any weighted material.

U.S. Pat. No. 1,650,634 to LUTZLER et al. discloses metal broiler pan with a drain pan, a support grid, and a tray disposed between to direct fluids into a center aperture into the drain pan. The drain pan is made from metal for use in cooking specifically broiling. The meat to be cooked is placed on the edge support grid and the drippings fall through the grid to the tray. The tray is formed to direct the fluid through the center aperture and into the drain pan.

U.S. Pat. No. 6,874,549 to Williams discloses a plastic molded transportable oil drain pan with casters and a pour spout. The drain pan may be placed under the drain port to catch fluid and is easily transported by the castors to a disposal point. The pour spout is uncapped and the contents discharged without spillage.

U.S. patent application Ser. No. 11/422,802, Publication No. 2007/0000944 A1 by Cahen et al. discloses a molded plastic beverage drip tray with a removable drip support grid. Further, it discloses finger hole in the support grid for removal. Beverage containers are placed on the support tray for filling and any over fill or spillage is drained through the support grid into the drip tray.

Another drain pan that is known in the art is the oil change drain pan, such as the Biltz USA™ 6 Quart Oil Drain. Such pans are usually made from molded plastic, have a plastic support grid, and transport sealing cap. The drain pan is placed under the drain port and oil is allowed to drain into the pan through large apertures in the support grid. The support grid is formed to support the weight of an oil filter and to catch a drain plug. When draining is complete the sealing cap is placed over the drain pan opening to allow for transport or storage. In some cases the drain pan is formed with a pour spout or drainage port to assist in disposal.

Also known in the art is the modern metal broiler pan coming in a variety of configurations. These drain pans have a support plate that rests on or over the edge of the drain pan. The support plate has a plurality of apertures and may have flow directing form.

In the prior art, a plate or a pan was placed on the counter or in the refrigerator to collect the drippings from thawing or stored food, and absorbents are placed into drawers, if any means of collection was employed. Both methods leave the drippings in contact with the food and in some cases in contact with other foods increasing the likelihood of spoilage. Poor butcher's wrappings and unsealed containers allow for fluids to seep under the food and sit for an extended period creating an unsanitary storage area and difficulty in cleaning. In the case where a plate or pan is used the food is left partially submerged in the fluid. Although the fluid is contained it is not allowed to flow away from the food. Further, refrigerator drawers, with or without absorbents are difficult to clean, causing perpetual unsanitary conditions.

In industrial applications, where the cost or practicality of heavy drainage trays is preventive, the prior art may be a bucket or absorbents to collect oil or other fluid. Similar to the food storage application the components are not free from the collecting fluid. Thus, preventing the complete drainage of the liquid from the component. Further, the use of mechanical filtration of the liquid for inspection or retrieval of smaller component parts is impractical, without added equipment and steps.

In both the food and industrial application of the prior art the support plate of the drip trays were edge supported. Where a substantial weight was to be supported the plate was made from steel of other heavy material, such as the Rhino Drip Tray Pan Insert™, requires a bulky unit made from costly materials. The weight and size of the unit itself becomes a limiting factor for a range of applications.

Where a lighter weight is to be supported a material such as plastic is usually employed, but is limited to insubstantial weight support due to deformation of the plate or ductile or brittle failure.

The present invention seeks to resolve the issue of collection of drained liquids in a light weight, inexpensively constructed unit while having the capacity of supporting a substantial weight above the fluid collection pan.

SUMMARY OF THE INVENTION

A universal drain pan with a complementary insert plate, each having supporting members that align to provide support throughout the plate, allowing for weighted objects to be placed upon the plate without deformation or failure. The drain pan may be used in refrigerator shelves and drawers or counter tops for supporting thawing, stored, or prepared foods, allowing for drainage of fluid into the pan away from the food to prevent spoilage. The pan may also be used in industrial applications on any flat surface to allow for drippage or drainage of machine components while being worked, prior to storage or pre-installation. The insert has a series of funneled drain holes to direct the fluid into the pan and may have a mechanical filtration means, such as a screen, to prevent entrained foreign material and small component pieces from going into the fluid in the drain pan. The screen also allows for inspection of, or retrieval of material prior to disposal or recovery. A drainage port is provided in the wall of the drain pan to ease disposal and a lid is provided for transfer of the fluid to the disposal site or for storage.

The drain pan constructed of the appropriate material and size for the intended application may be used in lieu of paper and fabric towel absorbents cutting down on waste and laundry.

The inexpensive construction makes molding of units or various shapes and sizes practical. The pan can be made deep or shallow to accommodate various anticipated fluid volumes and can be molded to fit within enclosures such as refrigerator drawers or built into counters and drawers.

DETAILED DESCRIPTION OF THE INVENTION

The following detailed description is the best mode currently contemplated for carrying out the present invention and refers to the figures as an example of an embodiment and not a limitation of the invention or combination of the claimed elements.

A universal drain pan will be described through FIGS. 1 through 4 of the drawings with reference numbers corresponding to the applicable drawing. The universal drain pan 20 can be placed on, into, or built into drawers and surfaces. The drain pan 20 and insert plate 10 may be made of plastic, metal, or other suitable material and may be formed in any size, depth, or shape to suit the intended purpose. In the preferred embodiment the drain pan 20 and the insert plate 10 are molded plastic. The plastic mold may be treated with an effective amount of an antimicrobial agent, such as Microban™, during construction to increase sanitary effectiveness for use in food preparation and storage.

Figure 1:
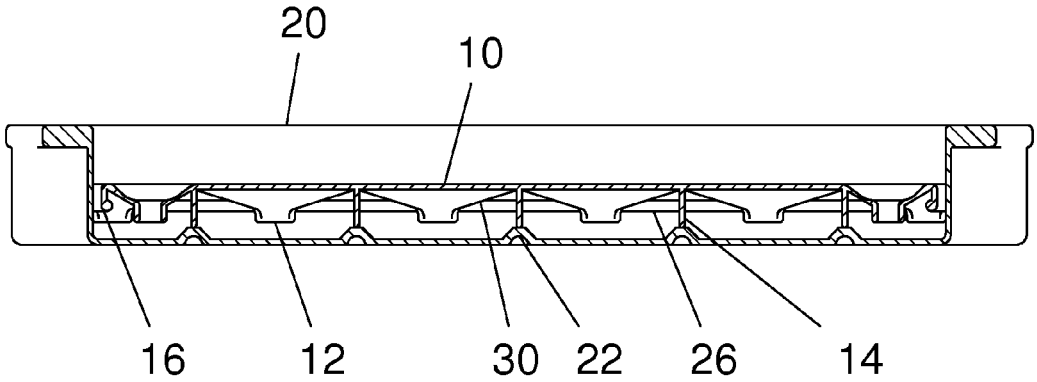
FIG. 1 shows a side cross sectional view taken along line A-A of FIG. 2 of an assembled drain pan according to an embodiment of the invention.

FIG. 1 The universal drain pan 20 having a plurality of pan ridges 22 on the inner bottom surface and a complementary insert plate 10 that fits within the peripheral wall. The insert plate 10 having a series of plates support rips 14 that align with the pan ridges 22 to provide support to the insert plate 10. The insert plate 10 having a plurality of apertures 12 to allow for draining of liquid through the plate. The insert plate 10 being formed into a plurality of drain funnels 30 directing drainage fluids to the apertures 12. The insert plate 10 further having a plurality of drain edge spaces 16 to allow drainage at the perimeter of the insert plate.

Food such as meat or produce, or lubricated machine components may be placed on to the insert plate 10. The weight of the objects placed on the insert plate 10 is supported by the alignment of the pan ridges 22 and the plate supports 14. The pan ridges 22 and plate supports 14 may be continuous or intermittent along the length of the drain pan depending on the application support requirements. Additional support may be achieved by providing cross supports 26 between the plate supports 14. In some embodiments of the invention a lip support may be added to the inner side of the drain pan 20 peripheral wall.

The liquid runoff or drippage falls to the insert plate 10 and into the drain pan, away from the food or component, via the apertures 12. The apertures 12, sufficient for most run off, may have increased drainage capability by forming drain funnels 30 into the insert plate 10. The accumulation of runoff liquid at the edge of the insert plate 10 is prevented by edge spacers 28 provided on the peripheral edge. In some embodiments of the invention the insert plate 10 will be disposed substantially lower than the drain pan 20 peripheral wall open edge providing for containment of a drainage fluid surge as the fluid is directed into the drain pan 20.

Figure 2:
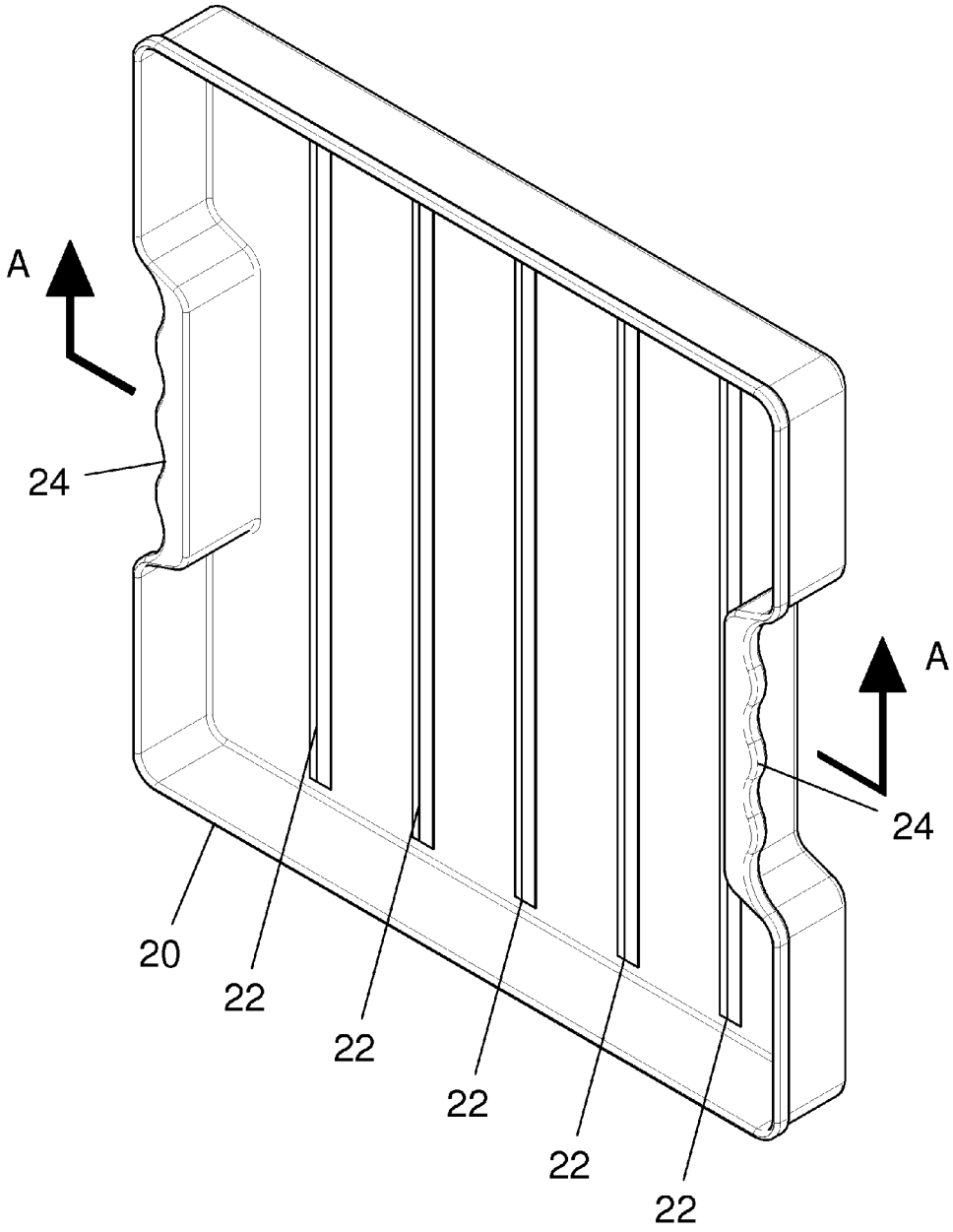
FIG. 2 shows a perspective view of a drain pan according to an embodiment of the invention.

FIG. 2 The drain pan 20 may be formed with hand grips 24 to allow for placement, removal, and transport without tipping the pan, potentially upsetting the fluid. This also allows for the entire unit to be placed within or removed from an enclosure such as refrigerator drawers.

Figure 3:
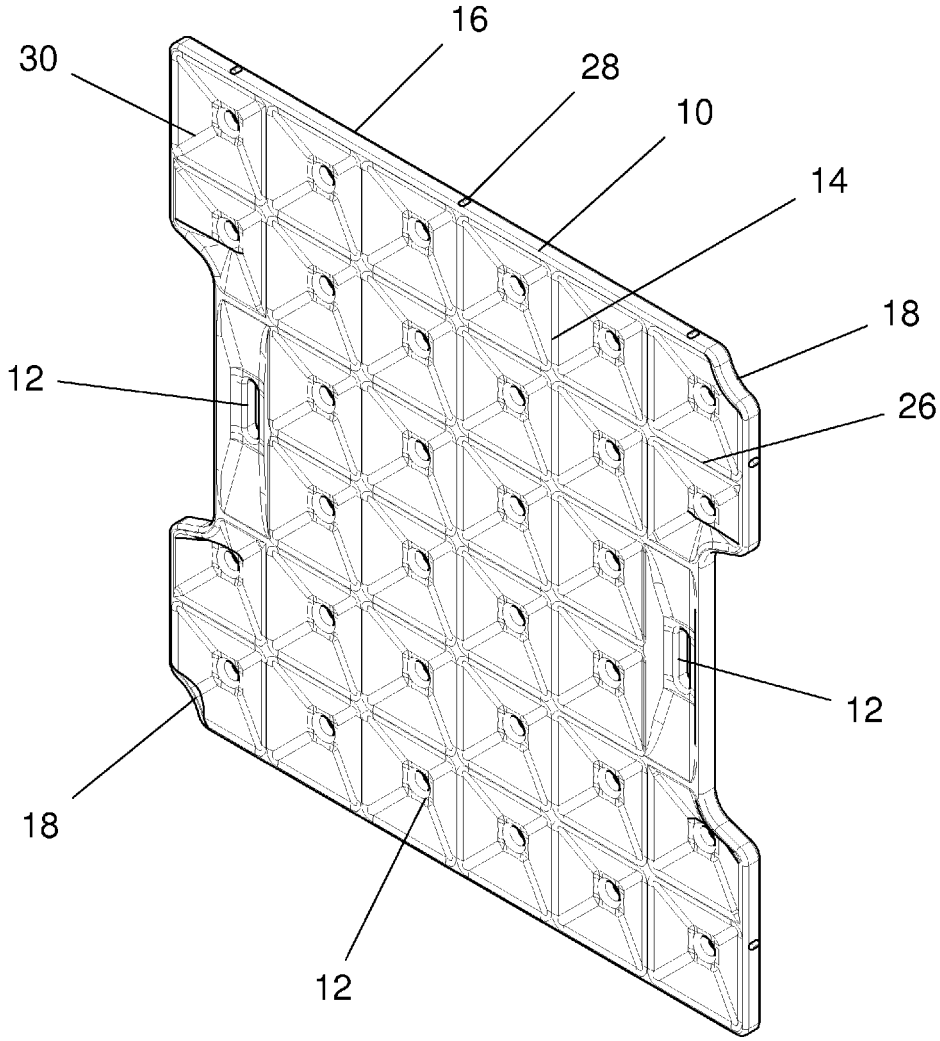
FIG. 3 shows a perspective view of an insert plate according to an embodiment of the invention.

FIG. 3 The insert plate 10 may be formed with finger holes 18 to allow for the removal without tipping or prying potentially upsetting the fluid. The finger holes 18 molded with the drain funnels 30 to maximize cleanliness of the holes, but not interfere with the drainage capability. A plurality of drain edge spacers 28 are provided for drainage at the perimeter of the insert plate through drain edge spaces 16.

Figure 4:
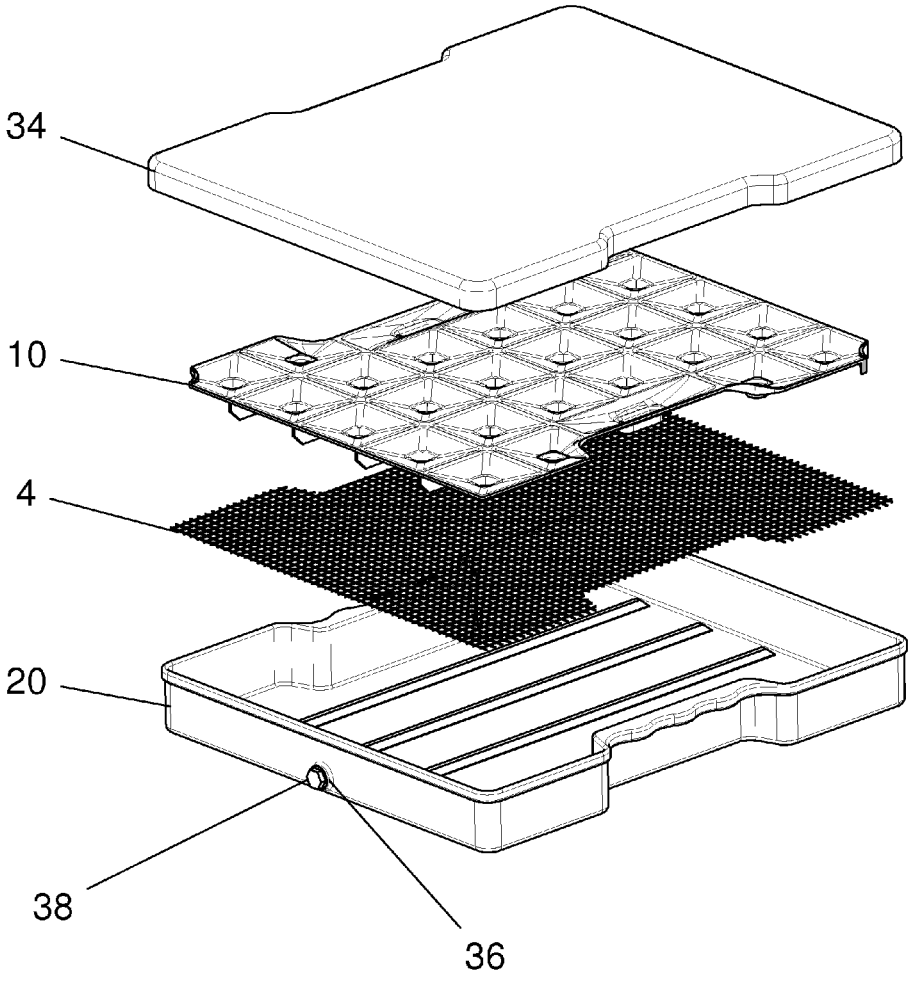
FIG. 4 shows an exploded view of the drain pan according to an embodiment of the invention.

FIG. 4. Optionally, a mechanical filtration means, such as a screen 4, may be disposed between the drain pan 20 and the insert plate 10, to collect foreign material for inspection, or to ensure purity for recovery of the fluid drained. The screen 4 may also catch mechanical assembly components, such as, nuts, washers, and the like.

In some embodiments of the invention a drain port 36 is provided in the lower portion of the drain pan peripheral wall to assist in the recovery and disposal without spillage. A cap 38 is provided for the port to prevent leakage while the drain port 36 is not in use.

The food or machine component is removed from the insert plate 10, which may be removed from the drain pan 20, allowing unobstructed access for disposal or recovery of the fluid. If a screen is provided, inspection of foreign material may be performed prior to recovery or disposal of the fluid.

Where the fluid is not to be immediately disposed or recovered a sealing lid 34 may be placed over the drain pan 20 for transportation or storage.

The drain pan 20 and the insert plate 10 may be washed separately manually or placed into a dish washer for sanitation.

What is claimed is:

1. A fluid drainage and containment apparatus, comprising:

a drain pan having an inner bottom surface and a peripheral side wall extending upward forming an upper opening; with one or more pan ridges configured on and extending upward from the inner bottom surface;

an insert plate disposed to fit inside of the drain pan, having a first upper surface and an opposing second surface with a plurality of apertures extending through said plate from said first surface to said second surface;

a plurality of plate supports configured on the second surface of the insert plate, the plate supports disposed to complementarily fit onto the pan ridges of the drain pan to support said insert plate above said bottom surface of said drain pan; and a plurality of lateral supports disposed perpendicular to the plate supports.

2. A fluid drainage and containment apparatus as defined in claim 1, wherein the plurality of apertures further comprises a plurality of drain funnels configured on the first surface of the insert plate, the drain funnels disposed to direct the liquids to the second surface and to the drain pan.

3. A fluid drainage and containment apparatus as defined in claim 1, further comprising one or more finger holes configured into the insert plate.

4. A fluid drainage and containment apparatus as defined in claim 1, further comprising a plurality of spacers disposed around a peripheral edge of the insert plate.

5. A fluid drainage and containment apparatus as defined in claim 1, further comprising hand grips formed in the peripheral wall of the drain pan.

6. A fluid drainage and containment apparatus as defined in claim 1, further comprising a support lip is disposed on the inner side of the drain pan peripheral wail.

7. A fluid drainage and containment apparatus as defined in claim 1, further comprising a mechanical filtration means disposed between the insert plate and the drain pan to collect foreign material.

8. A fluid drainage and containment apparatus as defined in claim 1, wherein the insert plate disposed substantially lower than the upper opening formed by the drain pan peripheral wall.

9. A fluid drainage and containment apparatus as defined in claim 1, further comprising a drain pot disposed in the peripheral wall of the drain pan.

10. A fluid drainage and containment apparatus as defined in claim 1, further comprising a sealing lid configured to seal said upper opening of said drain pan peripheral wall.

11. A fluid drainage and containment apparatus as defined in claim 1, wherein: the drain pan and insert plate are treated with an effective amount of an antimicrobial agent.

* * * * *